US005078813A

United States Patent [19]

Tucker et al.

[11] Patent Number: 5,078,813

[45] Date of Patent: Jan. 7, 1992

[54] EXPOSIVE GRADE AMMONIUM NITRATE

[75] Inventors: Gerald L. Tucker; Bobby P. Barrington, both of Yazoo City, Miss.

[73] Assignee: Mississippi Chemical Corporation, Yazoo City, Miss.

[21] Appl. No.: 327,044

[22] Filed: Mar. 22, 1989

Related U.S. Application Data

[63] Continuation-in-part of Ser. No. 34,947, Apr. 6, 1987.

[51] Int. Cl.[5] ..... C06B 31/28; C06B 45/34

[52] U.S. Cl. ..... 149/7; 149/45; 149/46

[58] Field of Search ..... 149/7, 45, 46

[56] References Cited

U.S. PATENT DOCUMENTS

| | | | |
|---|---|---|---|
| 3,103,857 | 9/1963 | Grossmann | 149/46 |
| 3,223,478 | 12/1965 | Wilson | 149/7 |
| 3,326,734 | 6/1967 | Slykhouse | 149/45 |
| 3,493,445 | 2/1970 | Takata et al. | 149/46 |
| 3,684,597 | 8/1972 | Robins et al. | 149/46 |
| 3,764,419 | 10/1973 | Sheeran et al. | 149/7 |
| 3,779,821 | 12/1973 | Fujiki et al. | 149/7 |
| 3,781,180 | 12/1973 | Harrison et al. | 149/46 |
| 3,830,672 | 8/1974 | Lista | 149/7 |
| 3,834,955 | 9/1974 | Fox et al. | 149/7 |
| 3,966,853 | 6/1976 | Osako et al. | 149/46 |
| 4,093,478 | 6/1978 | Hurst | 149/46 |
| 4,111,728 | 9/1978 | Pamnarace | 149/7 |
| 4,124,368 | 11/1978 | Boyars | 149/46 |
| 4,736,683 | 4/1988 | Backman et al. | 149/60 |

OTHER PUBLICATIONS

C. J. Dahn et al., *Proceedings 6th Conf. Soc. Explosive Engrs.*, 89–104 (1980).

*Primary Examiner*—Edward A. Miller

*Attorney, Agent, or Firm*—Oblon, Spivak, McClelland, Maier & Neustadt

[57] ABSTRACT

An explosive-grade ammonium nitrate product dimensionally stabilized with a hydratable internal additive in an amount from 0.05 to 2.0% (wt/wt), having a bulk density in the range from 0.80 to 0.96 gm/cm$^3$, exhibiting a porosity such that the product will absorb and retain at least 5% (wt/wt) of a fuel oil, retaining a particulate (prill) hardness of at least 15 kg/cm$^2$ and having a Caking Index of less than 1.4 kg/cm$^2$.

12 Claims, No Drawings

EXPOSIVE GRADE AMMONIUM NITRATE

CROSS REFERENCE TO RELATED APPLICATION

This application is a continuation-in-part of application Ser. No. 07/034,947 filed Apr. 6, 1987.

BACKGROUND OF THE INVENTION

1. Field of the Invention

The present invention relates to an explosive grade ammonium nitrate product.

2. Description of the Background

Ammonium nitrate by itself is a very stable material and is incapable of exploding. However, when fuel oil such as #2 diesel oil is added to ammonium nitrate (AN) in an oxygen balanced ratio, the product produced (ANFO) is an effective blasting agent which requires a high explosive charge to initiate detonation. A high explosive, on the other hand, is a substance whose detonation can be initiated by moderate shock from the likes of a blasting cap. Actually, ANFO has long been known, as early as the 1860's. In order to be effective as a blasting agent the fuel oil must be distributed throughout the explosive grade ammonium nitrate. The simple coating of the surface of relatively large AN prills results in a poorly performing explosive product. In fact, it was the need for intimate ammonium nitrate-fuel oil contact that originally led to the development of low density explosive grade ammonium nitrate (Lo-D XAN), which is normally produced by prilling an ammonium nitrate melt containing a relatively high amount of moisture, usually about 4–8% by weight. As the molten AN droplets solidify in the prilling tower, the high moisture content of normally about 4–6% of the prills causes "sintering" of the prills or a prill structure containing many micropores. The prills are dried to a moisture content less than 0.5%, have a bulk density usually ranging from 0.72–0.8 gm/cm$^3$ and have a Caking Index measured as high as about 4.4 kg/cm$^2$ which is much greater than the prills of the present invention. Further, the prills have a moderate-to-low crushing strength of about 25 kg/cm$^2$. Then the prills are coated with a conditioning agent or coating. The coating is necessary to reduce prill caking tendency and may to some extent, facilitate fuel oil absorption. However, this increased oil absorption is a surface effect, with none of the oil being dispersed into the interior of the prill where it is needed. In fact, in some instances the coating agent may plug surfacial entrances to the substrate pores which reduces the energy released upon detonation of the XAN.

The drying step in the production of low density explosive grade AN (Lo-D XAN) is very important, because several functions are served in this step. One aspect of drying is that drying promotes prill porosity and aids in the development of surface access to the internal micropore structure. The internal porosity of the prills is not of much value unless the structure provides access to the interior pores from the exterior. A second aspect is that drying eliminates excess prill moisture which can interfere with the subsequent absorption of oil resulting in a lessening of the explosive force generated by the AN-fuel oil (ANFO) composition. Yet another aspect is that drying removes moisture which leads to caking during storage of explosive-grade ammonium nitrate (XAN, which is processed into ANFO).

Most manufacturers of low density XAN do not form AN prills in the presence of a stabilizing additive because the additives have an adverse effect on the drying of the prills. As a consequence, XAN is not dimensionally stabilized, is inherently susceptible to prill breakdown, and cakes during storage. The problems caused by moisture retained in the prills and the substantial increased costs incurred by the necessity of having to use processing equipment capable of removing the relatively high amounts of moisture and the large amount of energy required to achieve drying are more significant factors than the advantages gained by use of internal additives. Still further, because of the low density of the ammonium nitrate, more blasting holes or larger diameter blasting holes must be drilled in order to obtain a sufficient blasting effect. Consequently, low density XAN manufacturers have to contend with inherent product quality problems.

In attempting to alleviate the caking problem of low density XAN, manufacturers use coating or "parting" agents in the preparation of the prilled product. However, only several of these coatings such as Petro Ag, Petro Ag-treated kaolin, and the like may be employed since many of the coating agents not only interfere with oil absorption by the prills, but they also diminish ANFO's explosive force. Thus, the degree of protection offered by the coating agent is usually much less than is desired.

Hurst, U.S. Pat. No. 4,093,478 discloses an explosive ammonium nitrate composition quite different from that of the present invention. The explosive of the reference is a two component formulation in which one component is a liquid fuel comprised of hydrocarbon derivatives having an oxygen equivalent weight less than about 4 grams per equivalent. The second component is activated ammonium nitrate prills apparently of the low density type. In order to increase the porosity of the prills, the same are treated with moisture in an amount ranging from 0.3 to 6% by weight which is subsequently evaporated to create voids therein. The ammonium nitrate however does not contain any internal additives and, because of its increased porosity, exhibits diminished stability, i.e., a markedly increased tendency to crumble and disintegrate. Further, this processing of ammonium nitrate is not the processing which occurs in the present invention.

Bachman et al, U.S. Pat. No. 4,736,683 describes an ammonium nitrate blasting material which is based upon a high density ammonium nitrate. In this invention, however, fuel oil retention is provided on the ammonium nitrate particles by a stringy, high molecular-weight polymer. The high density prills are not sufficiently porous to absorb fuel oil. Although Bachman et al teaches thermal cycling of prills to increase porosity, the increased porosity is achieved by cracking of the prill surfaces and probably the infrastructure of the prills. Such prills are structurally weakened unlike the XAN product produced by the process of the present invention.

Osako et al, U.S. Pat. No. 3,966,853 describes an explosive ammonium nitrate material prepared from ammonium nitrate prills in turn prepared by prilling ammonium nitrate containing from 2 to 7% water. The ammonium nitrate prills are thus low density ammonium nitrate prills. Accordingly, the patent does not show an explosive grade ammonium nitrate which is a high density material.

On the other hand, high density ammonium nitrate, because of its inherently low porosity, does not make a good AN-fuel oil, blasting agent. Unless the high density prills are made very small, the desired amount of fuel oil (albeit, on the surface of the AN prills) cannot be achieved. Normally, ANFO is such that the ammonium nitrate prills must absorb at least about 6% (wt.) fuel oil. High density AN prills which have a low moisture content, which is necessary for good storage characteristics, even when they contain an internal additive, do not make a very effective blasting agent.

It is further pointed out that ammonium nitrate production equipment is designed for the type of product it produces, i.e., high density AN or low density AN. Very little, if any, drying is needed for high density AN, and it can be prepared by simply cooling the ammonium nitrate, rather than by drying and then cooling ammonium nitrate as is required for low density AN. In the manufacture of high density AN, water is removed in the melt evaporator. High density AN evaporators, therefore, must have a greater water-removing capacity than low density AN evaporators at comparable production rates. It is possible (although not practical) to produce both low density and high density AN in a given production train, but this is only achieved at the expense of an extreme loss in production rate or a tremendous decline in product quality. These limitations greatly reduce the flexibility of AN processes. A need therefore continues to exist for a simplified way of producing explosive grade ammonium nitrate from high density fertilizer grade ammonium nitrate.

SUMMARY OF THE INVENTION

Accordingly, one object of the present invention is to provide an explosive grade ammonium nitrate which has an unpacked bulk density greater than low density ammonium nitrate and which at the same time has a porosity which enables the absorption of a sufficient quantity of fuel oil to give an acceptable oxygen balanced ammonium nitrate-fuel oil product.

Another object of the invention is to provide an explosive grade ammonium nitrate prill which is dimensionally stabilized by an internal additive against undesired breakdown and which stores satisfactorily without the need for a large amount of coating/ conditioning agent.

Still another object is to provide a process for producing explosive grade ammonium nitrate which precludes having to employ large, costly prill dryers to remove excess moisture and which involves a reasonable capital investment compared with other ammonium nitrate production facilities.

Another object of the invention is to provide a process for producing fertilizer grade ammonium nitrate or explosive grade ammonium nitrate in the same production apparatus without suffering substantial reductions in production rates and diminished product quality.

Another object of the invention is to provide a process which allows the conversion of high density fertilizer grade ammonium nitrate into explosive grade AN at sites which are remote and not integral with fertilizer grade ammonium nitrate manufacturing facilities.

Briefly, these objects and other objects of the present invention as hereinafter will become more readily apparent can be attained by a high density explosive grade ammonium nitrate which is dimensionally stabilized with from 0.05 to 2.0% of an internal additive, which has a porosity such that the unpacked bulk density ranging from 0.80 to 0.96 gm/cm$^3$, a porosity and such that the product will absorb and retain at least 5 wt. % of fuel oil, which retains a prill hardness of at least 15 kg/cm$^2$ and which possess a caking index of less than 1.4 kg/cm$^2$.

DETAILED DESCRIPTION OF THE PREFERRED EMBODIMENTS

Typical high density ammonium nitrate, which is the starting material of the present process, as it is produced at a manufacturing facility, is very non-porous. It normally has a bulk density ranging from 0.96 to 1.04 gm/cm$^3$, a high crushing strength normally well above 30 kg/cm$^2$ and a molar ratio of water to non-hydrated internal additive (if it contains the same) equivalent to about 25% of the additive's highest hydratable state. It may also be provided with a protective coating agent of up to 2% wt/wt. This product exhibits a low porosity as indicated by the fact that it absorbs and retains less than about 1% wt/wt of fuel oil. If it is repeatedly thermally cycled (assuming that it contains about 0.5% of a non-hydrated internal additive), it will not exhibit an increase in porosity nor consequently will it absorb and retain any significant amount of fuel oil. If the high density ammonium nitrate does not contain a hydratable internal additive and is repeatedly thermally cycled, the ammonium nitrate prills may increase in porosity and consequently may exhibit increased oil absorption and retention. However, this is achieved at great sacrifice in prill crushing strength and an increase in the caking tendency of the ammonium nitrate prill. This is also true if the ammonium nitrate prills contain a non-hydratable additive such as Permalene TM.

An important aspect of the present invention is that prilled high density ammonium nitrate contains a hydratable internal additive. Normally, when high density ammonium nitrate prills are manufactured, they contain less moisture than required to hydrate the internal additive. The moisture content of ammonium nitrate which is prilled to form high density material is normally about 0.5% or less, preferably 0.25 to 0.35 wt. %. The amount of hydratable internal additive is sufficient to bond with all the moisture in the prill. For example, if the prills contain 0.5% (expressed as MgO) magnesium nitrate additive, the additive's ability to bond six moles of water per mole of MgO, ensures no "free" moisture unless the prill exceeds about 1.3 (wt.) % water. This prilled high density ammonium nitrate possesses excellent prill hardness (high crush strength), a very low Caking Index and since there is no free moisture in the prills, is not subject to prill breakdown when exposed to temperature cycles. The prills will not experience changes in the form IV to form III crystalline morphology when their temperature is cycled through the temperature range of this particular crystal transition.

The prilled high density ammonium nitrate of this invention has an internal additive content normally ranging from 0.05 to 2.0% (wt/wt), preferably 0.1 to 1.0%, most preferably 0.25–0.55%. Suitable hydratable additive materials include magnesium nitrate, calcium nitrate, polyphosphates and the like. The prilled high density ammonium nitrate further has an unpacked bulk density ranging from 0.80–0.96 gm/cm$^3$, preferably from 0.88 to 0.93 gm/cm$^3$, as the density is determined by weighing 500 cm$^3$ of unpacked AN prills of −8 Tyler Mesh particles. In fact, the bulk density is a relative indicator of porosity, i.e., as the prills become more porous as a result of increasing internal void space, the bulk weight of prills occupying a fixed volume must decrease.

The ammonium nitrate product of the invention is prepared by moisturizing high density ammonium nitrate prills which contain the stated amount of hydratable internal additive. The prills are moisturized in a humidification chamber until the amount of water absorbed by the prills is at least sufficient to fully hydrate the internal additive. For example, in the event the internal additive is $Mg(NO_3)_2$, which may associate with as many as six water molecules of hydration, the molar ratio of water to additive is normally 6 to 10, preferably 6 to 8. Normally, the high density prills to be humidified as obtained are provided with a protective coating of any type conventionally used. One such preferred coating is from 0.01 to 0.055 wt. % of siloxane-amine mixture. The coating does not interfere with moisture absorption, although it is possible to use uncoated prills in the moisturizing step.

The ammonium nitrate prills are moisturized in a vessel containing the same by passing humidified air therethrough until moisturization to the extent desired is achieved. Normally, air humidified to a relative humidity of from 50% to 75% is employed at a temperature of from 23° to 49° C. over a time period of from 15 to 60, minutes preferably 25 to 30 minutes until the internal additive is 83 to 100% hydrated, preferably 90 to 100% hydrated. In a preferred embodiment of humidification, the moisturizing vessel is provided with atomizers for atomizing water. By this means the air in the vessel can be humidified while moisture absorption by the prills is occurring. This method of moisturizing substantially reduces the amount of humidified air which must be used.

After moisturization, the moistened prills are cycled over the temperature range necessary to cause the AN prills to undergo the crystalline transition IV→III→IV. Each time the prills go through this transition cycle, they experience about a 3–4% irreversible volumetric expansion which induces tiny pores within the prill structure. Usually from 1 to 6, preferably 1–3 of such transitions is sufficient to achieve sufficient internal pore development. In a preferred embodiment the prills are thermally cycled over a temperature range of 20° to 52° C. at least twice, preferably from 26° to 43° C. two to four times. The presence of free water in the ANF prill is essential because the prill will not expand and become porous during temperature cycling if it does not contain any free (unbound) water. Actually, a prill without any free moisture only undergoes very slight volumetric expansion even after many temperature cycles.

The temperature cycling feature of the process allows one to control the porosity of the AN product, and therefore the oil absorbing tendency of the XAN, by controlling the number of times the ANF prills are passed through the IV→III→IV crystalline transition cycle.

Once temperature cycling is complete, the prills can be dried to remove all free water and a small amount of water of hydration. Thus, the prills are stabilized against further, undesired expansion during storage. Usually drying is done at a temperature ranging from 20° to 52° C., preferably 49° to 54° C. It may also be desirable to protect the XAN prills against water absorption during storage by the art known techniques such as the use of moisture-proof bags, or the like, if the prills are to be stored for a long period of time before oil absorption. The final XAN product usually has a moisture content such that the molar ratio of water to internal additive (when $Mg(NO_3)_2$) ranges from 0–6, preferably 5.0–6.0, and the unpacked bulk density ranges from 0.80 to 0.96 gm/cm$^3$, preferably 0.88–0.93 gm/cm$^3$.

It is pointed out that it is not always necessary to dry the prilled XAN product following the crystalline transition cycling step. If the added moisture only slightly exceeds the amount necessary to fully hydrate the internal additive and if the product is not to be stored for very long before it is converted into ANFO, the drying step may be omitted.

At humidification levels considerably above the full hydration of the internal additive, the first aspect of the invention works very well. In fact, the volumetric expansion rate (increasing porosity) per temperature cycle is accelerated at higher prill moisture contents. However, the greater the humidification of the prills beyond complete hydration of the internal additive, the more the moisture that has to be removed in the drying step if the prills are to be stored.

Subsequent to drying of the prills, it is not necessary to coat the prills with additional coating agent. Most XAN manufacturers have to add relatively large amounts of coating agent before the products can be stored. Large amounts of coating agents may undesirably reduce the explosivity of XAN.

In the past it has been impractical for a high density AN manufacturer to use their equipment to make XAN. The ammonium nitrate melt for the production of low density XAN is usually prilled at 4–6% moisture content. The prills, after preparation, are usually dried to less than 0.1% moisture content in order to reduce prill breakdown and prill caking during storage and handling. The removal of this amount of moisture (upward of 50.0 kg per one thousand kg of prills) from these prills is energy intensive. Also, a relatively long dryer retention time is necessary so that the moisture in the prills may diffuse to the surface where it evaporates. Normally, high density prill production plants utilize equipment designed for relatively short, low-residence time coolers, since high density AN prills do not have to be dried. Consequently, high density AN plants cannot practically switch back and forth in the production of high density, then low density AN prills.

Although the present medium density AN product may require some prill drying, if it is to be stored for long periods of time, the amount of water which must be evaporated is very small in comparison to the amount of water which must be evaporated from low density AN prills. For the manufacture of the present prills, typically from 2.0–10.0 kg of water per one thousand kg of product is evaporated. If long term storage of the medium density prills is not required, no further drying of the prills as formed is required.

Implementation of the present invention permits coverting the high density AN product into AN prills of increased porosity.

Low density XAN affords a reasonably good blasting agent (ANFO), because the pore structure both absorbs the required fuel oil and provides microcavities or compression centers which are believed necessary to sustain the propagation of a detonation. However, the low unpacked bulk density of the XAN, which is usually less than 0.80 gm/cm$^3$, means that a reduced amount of ammonium nitrate is placed into fixed containers. High density AN, of course, would be capable of presenting a greater amount of ammonium nitrate in an explosive package. However, as stated above, high density AN lacks the pore structure for sufficient fuel oil absorption. The present AN product has the advantage of a higher density AN product which presents a greater amount of ammonium nitrate for a given container volume, while also having a sufficient porosity for the absorption of the necessary quantity of fuel.

Additional advantages of the XAN product of this invention is that although it contains a dimensionally-stabilizing internal additive, prill drying is not especially difficult, prill porosity is not significantly detrimentally decreased, and the product's explosivity is not adversely affected.

Having now generally described this invention, a further understanding can be obtained by reference to certain specific examples which are provided herein for purposes of illustration only and are not intended to be limiting unless otherwise specified.

The porosity of the explosive grade ammonium nitrate product of the invention can be determined very accurately and reproducibly by measuring the maximum amount of diesel fuel the prills absorb. The objective, of course, is to produce a prilled product having sufficient internal and surfacial voids or pores such that the prills will absorb and retain at least 6% wt/wt diesel fuel. The 6% value is the industrially accepted amount of fuel required to give an oxygen balanced blasting agent. There is no sufficiently valid reason for increasing the percentage of absorbed fuel oil much beyond about 6% based on the explosive force delivered by the AN fuel oil blasting agent. An acceptable minimum for absorbed fuel oil is about 5%.

The crushing strength of the prills is measured as the applied force required to cause a single ammonium nitrate particle to fracture. The greater the crushing strength, the less the undesired breakdown of the prills during handling and storage. It is desired that the prilled explosive grade product of the invention having a crush strength at least equivalent to available explosive grade products, preferably higher. Accordingly, a minimum crush strength of at least about 15 kg/cm$^2$ is desired, preferably at least about 25 kg/cm$^2$.

The Caking Index is the measure of intensity of interparticle bonding of 300 gm of ammonium nitrate prills which have been subjected to a constant force of about 3.5 kg/cm$^2$ for a period of 24 hours. The lower the force required to break interparticle bonding, the less likely the product will cake during storage. For the present invention, the maximum Caking Index should be about 1.4 kg/cm$^2$, preferably about 0.7 kg/cm$^2$, and most preferably about 0.3 kg/cm$^2$.

EXAMPLE

A sample of fertilizer grade ammonium nitrate has the following characteristics:

Total moisture—0.35 wt. %

$Mg(NO_3)_2$ —1.98 wt. % (0.55 wt. % as MgO)

Bulk Density—0.99 gm/cm$^3$ (unpacked)

Oil Absorption Capacity—0.6 wt. % (Centrifuge method)

Temperature—24° C.

Crystalline Form—III

Coating Agent—0.04% by wt. of an amine-siloxane coating

A sample of the above-identified ANF prills was exposed to humid air in a hydrator until the prills absorbed about 1.5% water which is equivalent to a molar ratio of water to "MgO" of 6:1. The humidification of the prills was conducted at a rate low enough to prevent the prills from becoming sticky, and at a rate sufficient to allow the absorbed moisture to diffuse into the prills. As soon as the prills had absorbed sufficient moisture to exceed the water:"MgO" mole ratio of 6, the prills changed from crystalline form III to crystalline form IV. This latter form of ammonium nitrate is the stable crystalline form below about 32° C. The prill temperature was then cycled twice over the range of 26° C.→43° C.→26° C., with each cycle taking about 4 hours. The data obtained after each cycle are shown in Table 1.

TABLE 1

| | Initial Prill | After Cycle 1 | After Cycle 2 |
|---|---|---|---|
| Bulk Density (unpacked), gm/cm$^3$ | 0.99 | 0.96 | 0.93 |
| Moisture Content, % wt. | 1.5 | 1.5 | 1.5 |
| Oil Absorption Capacity+, % wt. | 0.6 | 0.7 | 2.5 |
| Cumulative Prill Expansion, vol. % | — | 3.3 | 6.7 |

+Oil absorption was determined by the Centrifuge Method (Laboratory Procedure Manual)

Commercially available low density explosive grade ammonium nitrate has an oil absorption capacity of 2.2% as determined by the stated technique, which is equivalent to about 6% oil absorption, as determined by the "weighed addition" procedure.

A sample of the prilled product which had been through two temperature cycles was dried until the molar ratio of water to "MgO" was about 5.8. Further temperature cycling of the prills did not cause any additional volumetric expansion of the same.

The prills described above were passed through a number of temperature cycles of 30° C.-43° C.-30° C. and the volumetric expansion of the same was measured as a function of the prill moisture content to "MgO" molar ratio. The data in Table II show that very little expansion takes place until the $Mg(NO_3)_2$ is fully hydrated. After complete hydration, the expansion rate is about 3-4% per temperature cycle. Excess prill moisture, above that required to fully hydrate the $Mg(NO_3)_2$, does not significantly increase the rate or extent of prill volume expansion.

TABLE II

| Number of temperature cycles | % Volume Expansion Molar Ratio $H_2O/MgO = 1.3$ | $H_2O/MgO = 3.6$ | $H_2O/MgO = 4.6$ | $H_2O/MgO = 6.0$ | $H_2O/MgO = 7.8$ |
|---|---|---|---|---|---|
| 1 | 0 | 0 | 0 | 2 | 5 |
| 3 | 0 | 0 | 0 | 9 | 13 |
| 6 | 0 | 0 | 0 | 19 | 23 |
| 9 | 0 | 0 | 0 | 30 | 33 |
| 12 | 0 | 0 | 0 | 39 | 40 |

$Mg(NO_3)_2$ is fully hydrated at the water: "MgO" ratio of 6.0

It is not essential that the temperature cycling step take 4 hours. The heating and cooling phases need only be of sufficient duration to permit the IV→III and III→IV crystalline transitions to occur. Up to a reasonable moisture level, the transition rates are a function of both prill moisture content and limits of the cycling temperatures. Table III below provides data for complete crystalline transitions as a function of temperature and prill moisture content.

TABLE III

| Crystalline Transition | Temperature Required to Achieve Complete Crystalline Transition — Mole $H_2O$/Mole MgO | | | | | |
|---|---|---|---|---|---|---|
| | 2.7 | 4.2 | 5.3 | 5.8 | 6.6 | 9.0 |
| IV → III (Min.) | 39.5° C. | 40° C. | 39° C. | 36.7° C. | 36° C. | 34° C. |
| III → IV (Max.) | —* | —* | —* | —* | 29° C. | 30.6° C. |

*Less than 50% crystalline conversion even below 24° C.

The following is a series of comparisons of different types of ammonium nitrate with respect to several physical properties.

A. Single-Prill Hardness:

| Ammonium Nitrate | SPH, kg/cm² |
|---|---|
| high density ANF[a] | 38.1 |
| explosive grade XAN[b] | 29.0 |
| low density #1[c] | 18.5 |
| low density #2 | 34.4 |
| low density #3 | 28.3 |
| low density #4 | 25.2 |
| low density #5 | 25.0 |
| low density #6 | 38.3 |

[a]High density fertilizer grade ammonium nitrate starting material from which the explosive grade material of the present invention is prepared.
[b]Explosive grade ammonium nitrate product of the invention.
[c]Six commercially available low density ammonium nitrate materials.

A characteristic of many low density ammonium nitrate materials, when subjected to the SPH test, is that they flatten or crush rather than sharply fracture. Therefore, in some case the SPH values obtained give an impression that the product's physical strength is better than it actually is.

B. 24-Hour Caking:

| Ammonium Nitrate | BS, gm/cm² |
|---|---|
| high density ANF[a] | 0 |
| explosive grade XAN[b] | 0 |
| low density #1[c] | 2,041 |
| low density #2 | 985 |
| low density #3 | >4,400 |
| low density #4 | 4,222 |
| low density #5 | ND |
| low density #6 | ND |

[a,b,c]Footnotes as described in A. above
ND = No Data

BS (Breaking Strength) is defined as the force (in g/cm²) required to break the cakes formed after subjecting about 300 g of the ammonium nitrate to a pressure of about 3.5 kg/cm² for 24 hours. The lower the BS value, the lower is the caking tendency of the product in normal storage.

C. Oil Absorption Capacity:

| Ammonium Nitrate | OAC, % wt. |
|---|---|
| high density ANF[a] | 0.85 |
| explosive grade XAN[b] | 6.5 |
| low density #1[c] | 5.1 |
| low density #2 | 3.3 |
| low density #3 | 4.1 |
| low density #4 | 7.9 |
| low density #5 | 3.7 |
| low density #6 | 6.0 |

[a,b,c]Footnotes as defined in A. above

Since low density products are relatively soft (low SPH and flattening tendency), OAC can vary considerably from existing commercial product to product.

D. Pore Characteristics:

| Ammonium Nitrate | Total Intrusion Volume ml/gm | Median Pore Diameter, μm |
|---|---|---|
| high density ANF[a] | 0.0644 | 0.0125 |
| explosive grade XAN[b] | 0.1656 | 4.005 |
| low density #6[c] | 0.1994 | 15.087 |

[a,b,c]Footnotes as defined in A. above

These data were obtained by a technique using a Mercury Porosimeter. The Total Intrusion Volume is a measure of the void volume inside the prill. There is a very significant difference between the high density ANF starting material and the explosive grade product of the invention. The Median Pore Diameter, i.e., the general size of the pore, for the explosive grade product of the invention is about 25% as large as that for existing commercial low density #6. The product of the invention is more sponge-like in its outer portion than a prill of low density XAN, but it retains a harder core. This configuration gives an explosive grade product having both good prill hardness and good oil absorption.

Oil Absorption Capacity Test

The method employed in the present invention for determining the oil absorbing capacity of ammonium nitrate is based on the ability of ammonium nitrate to absorb diesel oil. Ammonium nitrate prills are immersed in excess diesel oil and thereafter excess oil is removed by centrifugation. The increase in weight of the prills is attributed to oil absorbed by the prills.

Procedure:

1. An even number of Gooch crucibles are washed and dried at 220° F. (An even number is required to balance the centrifuge.)
2. The crucibles are cooled to room temperature in a vacuum desiccator.
3. The weight of a Gooch crucible is recorded, making sure that the crucible has some kind of identifying mark on it.
4. The crucible is filled with ammonium nitrate to a total weight including the crucible of about 30 grams. The total weight is recorded and the ammonium nitrate sample weight is obtained by difference.

5. A 150 ml beaker is filled with about 80 ml of fresh #2 diesel fuel. (Old diesel fuel contains impurities which can invalidate the test results.)
6. The crucible containing the prills is slowly immersed in the fuel oil and soaked for 15 minutes.
7. The crucible with sample are removed from the oil, allowed to drain, and then is wiped of excess oil. A 30 second drain time is normally sufficient.
8. A rubber sleeve is inserted into the top of a centrifuge tube. The crucible containing the sample is set in the rubber sleeve and secured by pressing it firmly into place.
9. Each tube has one or two paper towels in the bottom to soak up the oil pulled off the sample during centrifuging. (Each tube should have the same number of paper towels inside to ensure that the centrifuge assembly is balanced.)
10. The samples are centrifuged for 15 minutes at 1000 rpm and the crucibles are weighed with sample. The weight of oil absorbed is obtained by difference.

Calculation $$\% \text{ Oil Absorption} = \frac{\text{Wt. of Oil Absorbed} \times 100}{\text{Wt. of Sample} + \text{Wt. of Oil Absorbed}}$$

24-Hour Caking Test

The caking tendency of prilled or granulated fertilizer is determined by subjecting prilled or granulated ammonium nitrate to a pressure of 3.5 kg/cm$^2$ for 24 hours. The severity of caking is measured by the amount of pressure required to force ammonium nitrate through an opening located on the bottom of the sample cylinder.

Procedure:

1. A 300 g quantity of ammonium nitrate is weighed into a stainless steel cylinder. The weighed amount is gently shaked to level.
2. A cover plate is placed on the cylinder making sure it is level.
3. The cylinder is centered in a framework directly under a pneumatic ram so that the ram is seated in a small recessed area in the center of the cover plate.
4. The pneumatic pressure apparatus is adjusted to 3.5 kg/cm$^2$ and the apparatus is allowed to stand undisturbed for 24 hours at about 24° C.
5. After 24 hours, the pressure is released and the cylinder is removed from the rack.
6. The cover plate is removed and the plug is loosened on the bottom of the cylinder, but it is not removed. The cylinder is placed back on the rack in original position.
7. The ram is pushed upward, as far as possible. The stainless steel plunger is placed on top of the same centering it with respect to the cylinder. The ram is pulled downward with fingers until it is lined up with the recessed area in top of the plunger.
8. A waste pan is placed under the cylinder and the plug is removed.
9. Pneumatic pressure is slowly applied to the ram until ammonium nitrate is forced thru the opening at the bottom of the cylinder.
10 The pressure (g/cm$^2$) necessary to force sample thru the bottom of the cylinder is recorded.

Single Prill Hardness Test

This technique is a measure of the internal strength of individual ammonium nitrate prills.

Procedure:

1. A sample of ammonium nitrate prills is screened, retaining the −8 +10 mesh screen fraction. The prills employed in the test are those which lodge in the 10 mesh screen.
2. The zero is reset on a DPP Durometer (manufactured by John Chatillon and Sons, Inc.) with the dial face being turned if necessary.
3. A single prill is placed on the plunger beneath the Durometer.
4. The plunger is advanced upward, at a rate such that dial readings can be noted in increments of 0.05 kg, until the prill fractures. This insures that the break point of the prill will be accurately determined.
5. Ten randomly-collected prills are tested in this manner. Those prills which are so elastic as to deform, rather than fracture clearly, are discarded. If more than half of the ten prills tested, do not fracture clearly, no breaking strength is assigned to the sample.

Calculations

1. Prill Breaking Strength:

Kg/cm$^2$=Avg. Kg Reading/0.0346 cm$^2$ (cross-sectional area of prill)

2. Estimation of the Mean Prill Hardness of the Population ($\mu$)*

Useful when compairing coating agents, competitors products or prills produced under special conditions. Not required on routine samples.

$$\mu = X \pm \frac{Sx}{n} t$$

$\overline{X}$=Sample Mean
$S_x$=Sample Variance
N=No. of Samples
t=Statistical Factor obtained from table of t distribution.

Example Calculation of $\mu$

| Prill No. | Force Required to Fracture a Single Prill, Kg |
|---|---|
| 1 | 0.70 |
| 2 | 0.75 |
| 3 | 0.70 |
| 4 | 0.85 |
| 5 | 1.15 |
| 6 | 0.70 |
| 7 | 1.00 |
| 8 | 0.90 |
| 9 | 0.60 |
| 10 | 0.70 |

$\overline{X} = 0.81$
$S_x = 0.0257$
t = 4.781 - for a two-tailed test at the 99.9% level of certainty $$\mu = 0.81 + \frac{0.0257}{10}(4.781)$$

$\mu = 0.81 + (0.0081)(4.781)$
$\mu = 0.81 + 0.0389$
Range of $\mu$ = 0.77–0.85

This means that with 99.9% certainty the true population mean will be found between 0.77–0.85. This is in Kg. To convert to kg/cm$^2$ divide Kg by 0.0346.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Explosive-grade ammonium nitrate prills dimensionally stabilized with a hydratable internal additive in an amount of from 0.05 to 2.0% (wt/wt), having a bulk density in the range from 0.80 to 0.96 gm/cm$^3$, exhibiting a porosity which is set by moisturizing the hydratable internal additive within the prills to 83 to 100% hydration and thermal cycling of the moisturized prills from 1 to 6 times through the IV→III→IV transition cycle and which is such that the prills absorb and retain at least 5% (wt/wt) of a fuel oil, retaining a particulate (prill) hardness of at least 15 kg/cm$^2$ and having a caking index of less than 1.4 kg/cm$^2$.

2. The explosive-grade ammonium nitrate prills of claim 1 wherein said internal additive is magnesium nitrate, calcium nitrate, or a polyphosphate.

3. The explosive-grade ammonium nitrate prills of claim 1 wherein the internal additive is hydratable magnesium nitrate employed in an amount of 0.1-1.0%, as MgO.

4. The explosive-grade ammonium nitrate prills of claim 3, wherein the amount of said $Mg(NO_3)_2$ ranges from 0.25-0.55 wt. %.

5. The explosive-grade ammonium nitrate prills of claim 3, wherein the bulk density is 0.88-0.93 gm/cm$^3$.

6. The explosive-grade ammonium nitrate prills of claim 3, wherein said ammonium nitrate prills absorb and retain fuel oil in an amount of at least 6 wt. %.

7. The explosive-grade ammonium nitrate prills of claim 1, wherein the particulate hardness is at least 25 kg/cm$^2$.

8. The explosive-grade ammonium nitrate prills of claim 1, wherein the interparticle Caking Index is less than 0.7 kg/cm$^2$.

9. The explosive-grade ammonium nitrate prills of claim 1, wherein the interparticle Caking Index is less than 0.3 kg/cm$^2$.

10. The explosive-grade ammonium nitrate prills of claim 1, wherein said produce is coated with a protective coating.

11. Explosive-grade ammonium nitrate prills dimensionally stabilized with a hydratable internal additive in an amount of from 0.25 to 0.55% (wt/wt), having a bulk density in the range of from 0.88 to 0.93 gm/cm$^3$, exhibiting a porosity which is set by moisturizing the hydratable internal additive to 83 to 100% hydration and thermal cycling of the moisturizing prills from 1 to 6 times through the IV→III→IV transition cycle and which is such that the prills absorb and retain at least 6% (wt/wt) of fuel oil, retaining a particulate (prill) hardness of at least 25 kg/cm$^2$ and having a caking index of less than 0.3 kg/cm$^3$.

12. Explosive-grad ammonium nitrate prills dimensionally stabilized with a hydratable internal additive, prepared by a process comprising:

moisturizing a fertilizer grade high density ammonium nitrate product containing from 0.05 to 2% (wt/wt) of a hydratable internal additive until sufficient moisture is absorbed such that the molar ratio of water to non-hydrated internal additive is from 83-100% of its highest hydratable state;

thermally cycling the moisturized ammonium nitrate at least once over the temperature range sufficient to cause the IV→III→IV crystalline transition; and drying the resultant ammonium nitrate product to the extent of substantially eliminating any free water not bound as a hydrate with the internal additive from the thermally cycled ammonium nitrate.

* * * * *

UNITED STATES PATENT AND TRADEMARK OFFICE

CERTIFICATE OF CORRECTION

PATENT NO. : 5,078,813

DATED : JANUARY 7, 1992

INVENTOR(S) : GERALD L. TUCKER ET AL

It is certified that error appears in the above-identified patent and that said Letters Patent is hereby corrected as shown below:

Title page, after "[54]", delete "EXPOSIVE" and insert --EXPLOSIVE--.

| Col. | Line | |
|---|---|---|
| 1 | 1 | delete "EXPOSIVE" and insert --EXPLOSIVE--; |
| 6 | 56 | delete "cov-" and insert --conv- --; |
| Cols. 7 & 8, lines 56-66, Table II, change "6.0" to --6.0+--; In legend change "$Mg(NO_3)_2$ to --+$Mg(NO_3)_2$--; | | |
| 11 | 48 | after "pressure" insert --gauge of the test--; |
| 12 | 33 | insert --*-- before "Useful"; |
| 14 | 8 | delete "produce" and insert --product--; |
| 14 | 16 | delete "moisturizing" and insert --moisturized--; |
| 14 | 22 | delete "grad" and insert --grade--. |

Signed and Sealed this

Twenty-first Day of September, 1993

Bruce Lehman

*Attest:*

*Attesting Officer*

BRUCE LEHMAN

*Commissioner of Patents and Trademarks*